United States Patent [19]

Ozawa

[11] 4,273,093

[45] Jun. 16, 1981

[54] NON-CONTACTOR IGNITION SYSTEM FOR INTERNAL COMBUSTION ENGINES

[75] Inventor: Masayuki Ozawa, Himeji, Japan

[73] Assignee: Mitsubishi Denki Kabushiki Kaisha, Tokyo, Japan

[21] Appl. No.: 73,136

[22] Filed: Sep. 6, 1979

[30] Foreign Application Priority Data

Sep. 29, 1978 [JP] Japan ..... 53-121003

[51] Int. Cl.[3] ..... F02P 3/12

[52] U.S. Cl. ..... 123/653; 123/650; 123/602

[58] Field of Search ..... 123/148 CC, 148 E, 117 R, 123/119 C

[56] References Cited

U.S. PATENT DOCUMENTS

| | | | |
|---|---|---|---|
| 3,599,615 | 5/1969 | Foreman | 123/148 CC |
| 3,863,616 | 2/1975 | Wood | 123/148 E |
| 3,960,129 | 6/1976 | Hofer et al. | 123/148 CC |
| 4,034,731 | 7/1977 | Sato | 123/148 CC |
| 4,036,201 | 7/1977 | Burjon | 123/148 CC |
| 4,144,854 | 3/1969 | Katada et al. | 123/148 CC |
| 4,176,643 | 12/1979 | Boeghly | 123/148 CC |
| 4,184,467 | 6/1980 | Kato et al. | 123/148 E |

*Primary Examiner*—Charles J. Myhre
*Assistant Examiner*—R. A. Nelli
*Attorney, Agent, or Firm*—Oblon, Fisher, Spivak, McClelland & Maier

[57] ABSTRACT

A non-contactor ignition system for generating an ignition voltage under controlling a primary current of an ignition coil by a semiconductor switching element, comprises a capacitor which is charged by a first power source and repeats a charging and a discharging in each constant period; a semiconductor switching element for ignition timing which is connected to the capacitor and the input terminal of said semiconductor switching element; and a second power source which generates an output voltage which is connected in said input circuit of said semiconductor switching element for ignition timing and whose value is varied depending upon the variation of revolution velocity of an engine and which has a long period including at least the charging period of said capacitor.

4 Claims, 7 Drawing Figures

NON-CONTACTOR IGNITION SYSTEM FOR INTERNAL COMBUSTION ENGINES

BACKGROUND OF THE INVENTION

1. Field of the Invention

The present invention relates to a non-contactor ignition system for internal combustion engines which can control its ignition timing in a desired characteristic.

2. Description of the Prior Arts

Heretofore, a switching element such as thyristor and transistor is actuated by an ignition signal generated at the ignition timing synchronizing to the rotation of the engine to control a primary current passed through an ignition coil in such ignition system whereby the secondary voltage is applied as the ignition voltage.

In the ignition system, the ignition signal voltage generated in a signal generator coil which synchronizes to the rotation of the engine is fed as an ignition signal to the switching element. Accordingly, the lead angle characteristic of the ignition timing is depending upon the output waveform of the ignition signal and a desired lead angle characteristic required for the engine has not been disadvantageously given.

SUMMARY OF THE INVENTION

In accordance with the present invention, there is provided a non-contactor ignition system for internal combustion engines which provides a satisfactory lead angle characteristic required for the engine by controlling the lead angle characteristic for the ignition timing.

DETAILED DESCRIPTION OF THE PREFERRED EMBODIMENTS

Figure 1:
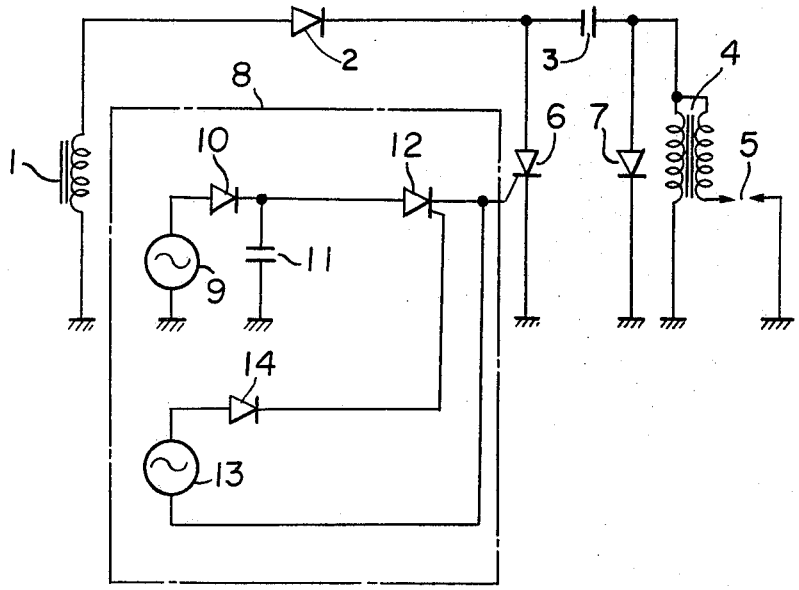
FIG. 1 is a circuit diagram of one embodiment of the ignition system of the present invention.

The embodiment of the present invention shown in FIG. 1 will be illustrated.

In FIG. 1, the reference numeral (1) designates a dynamo coil in an AC magneto generator driven by the engine (not shown) to generate an AC output voltage in synchronizing to revolution velocity of the engine; (2) designates a diode for rectifying an AC output of the dynamo coil (1); (3) designates a capacitor charged by the rectified output; (4) designates an ignition coil; (5) designates an ignition plug; (6) designates a thyristor as a semiconductor switching element which forms a discharge circuit for discharging charges charged into the capacitor (3) to the primary winding of the ignition coil (4); (7) designates a diode which bypasses an electromotive force generated in the ignition coil (4) so as to result suitable discharge in the ignition plug (5); (8) designates a lead angle characteristic control circuit as the important part of the present invention; (9) designates a first signal generator which is driven by the engine to generate output voltage at a predetermined ignition angle set in synchronizing to the revolution velocity of the engine; (10) designates a diode for rectifying the output of the signal generator (9); (11) designates a capacitor charged by the rectified output of the diode (10); (12) designates a thyristor as a semiconductor switching element or deciding ignition timing; and the anode of the thyristor (12) is connected to the capacitor (11) and the cathode thereof is connected to the gate of the thyristor (6) so as to form a discharge line for discharging the charge in the capacity to the gate of the thyristor (6).

A second signal generator (13) is driven by the engine to generate an AC output voltage which is varied regardless of variation of the revolution velocity of the engine. The first signal generator (9) and the second signal generator (13) are equipped in the AC magneto generator. A diode (14) feeds one wave in the AC output of the second signal generator (13) as an ignition signal to the gate of the thyristor (12). The gate circuit is a closed circuit which is independent from the other circuits.

Figure 2:
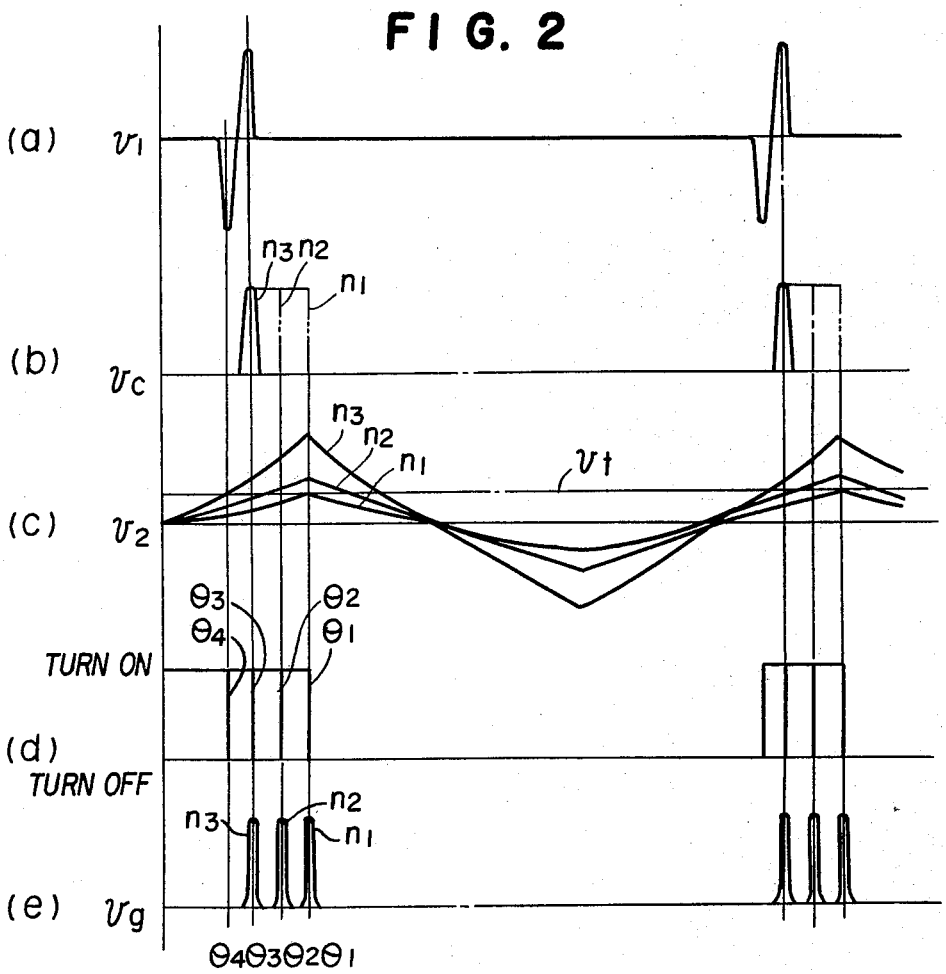
FIG. 2 is a diagram of waveforms in the ignition system.
Figure 3:
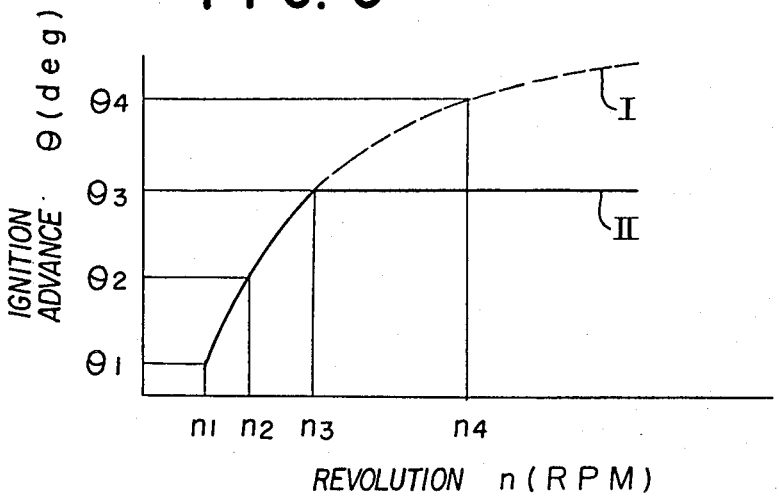
FIG. 3 is a lead angle characteristic curve diagram.

Referring to the operation waveform diagram shown in FIG. 2 and the lead angle characteristic curve diagram shown in FIG. 3, the operation of the ignition system having said structure will be illustrated.

In FIG. 2, the reference (a) shows the output voltage ($v_1$) of the first signal generator; (b) shows the charged voltage ($v_c$) between the terminals of the capacitors (11); (c) shows the output voltage ($v_2$) of the second signal generator (13); (d) shows the trigger timing of the thyristor (12); (e) shows the trigger voltage ($v_g$) of the thyristor (12); and ($v_t$) shows the trigger level of the thyristor (12).

The first signal generator (9) generates the output voltage ($v_1$) having a short period at the angle position corresponding to the maximum lead angle in the ignition of the engine. The second signal generator (13) generates the output voltage ($v_2$) having a long period including the short period of the output voltage ($v_1$) so as to correspond to the rise lead angle in the ignition period of the engine.

In FIG. 3, the reference (I) shows the lead angle characteristic obtained by the conventional ignition system; and the reference (II) shows the lead angle characteristic obtained by the ignition system of the present invention.

The magneto generator is driven by the rotation of the engine. The AC output generated in the generator coil (1) is rectified by the diode (2) to charge the capacitor (3). On the other hand, the output voltage ($v_1$) generated by the first signal generator (9) is rectified by the diode (10) to charge the capacitor (11). When the output voltage ($v_2$) generated by the second signal generator (13) reaches to the trigger level ($v_t$) in the ignition period of the engine, the output is fed through the diode (14) to the gate of the thyristor (12) whereby the thyristor (12) is turned on and the charge ($v_c$) in the capacitor (11) is fed to the gate of the thyristor (6). Then, the thyristor (6) is turned on and the charge in the capacitor (3) is discharged to the primary winding of the ignition coil (4) whereby the ignition voltage is formed in the secondary winding. An arcing is caused in the ignition plug (5) by the ignition voltage.

The lead angle operation by the lead angle control circuit (8) will be illustrated in detail.

The capacitor (11) is charged to the power voltage ($v_1$) by the output voltage ($v_1$) of the first signal generator (9). For the convenience of the illustration, the ranges of the revolution velocity of the engine are classified into the low revolution velocity ($n_1$), the middle revolution velocity ($n_2$) and the high revolution velocity ($n_3$) ($n_1 < n_2 < n_3$).

In the rising revolution velocity range from the low revolution velocity ($n_1$) to the middle revolution velocity ($n_2$), the AC output voltage ($v_2$) of the second signal generator (13) increases depending upon the increase of the revolution velocity. The trigger level ($v_t$) of the thyristor is constant. When the AC output voltage ($v_2$) increases, the angle position ($\theta$) to reach the trigger level ($v_t$) of the AC output voltage ($v_2$) gains (lead angle) depending upon the increase of the revolution velocity. The turn-on timing of the thyristor (12) gains from ($\theta_1$) to ($\theta_2$). Accordingly, the timing for feeding the trigger voltage ($v_g$) to the gate of the thyristor (6) is varied from ($\theta_1$) to ($\theta_2$). The ignition timing gains from ($\theta_1$) to ($\theta_2$) depending upon the increase of the revolution velocity (n) of the engine as shown in FIG. 3. Thus, the revolution velocity (n) of the engine is increased from the middle revolution velocity ($n_2$) to the high revolution velocity ($n_3$) whereby the AC output voltage ($v_2$) of the second signal generator (13) further increases and accordingly the angle position ($\theta$) for reaching to the trigger level of the thyristor gains and the turn-on time of the thyristor (12) is ($\theta_3$) shown in FIG. 3. When the revolution velocity (n) of the engine is increased over the high revolution velocity ($n_3$), the output voltage ($v_2$) of the second signal generator (13) is increased depending upon the increase of (n), so as to gain the turn-on time of the thyristor (12) to ($\theta_4$). However, the output voltage ($v_1$) of the first signal generator (9) is not yet generated and the capacitor ($v_c$) is not charged to ($v_c$) and accordingly, the turn-on time of the thyristor (12) is still kept in ($\theta_3$) without gaining to ($\theta_4$).

That is, when the revolution velocity (n) of the engine is increased over the high revolution ($n_3$), the thyristor (12) is kept in the state capable of turn-on by the output voltage ($v_2$) of the second signal generator (13). When it reaches to the angle position ($\theta_3$), the output voltage ($v_1$) generated by the first signal generator (9) is applied through the thyristor (12) to the gate of the thyristor (6) as the trigger voltage ($v_g$) whereby the thyristor (6) is turned on. Thus, the ignition timing of the engine is kept in ($\theta_3$) shown in FIG. 3 and is not any larger lead angle.

As described above, in the revolution velocity range of the engine from zero to ($n_3$) corresponding to the lead angle ($\theta_3$) in the embodiment, the ignition timing ($\theta$) automatically gains to ($\theta_1$), ($\theta_2$), ($\theta_3$) depending upon the increase of the revolution velocity ($\theta$) of the engine from the low velocity ($n_1$) through the middle velocity ($n_2$) to the high velocity ($n_3$) by potentially storing the charge caused by the output voltage ($v_1$) of the first signal generator (9) in the capacitor (11) and gaining the turn-on time of the thyristor (12) by the output voltage ($v_2$) of the second signal generator (13) which increases depending upon the increase of the revolution velocity (n) of the engine and feeding the charge ($v_c$) of the capacitor (11) through the thyristor (12) to the thyristor (6) to turn-on the thyristor (6).

When the revolution velocity (n) of the engine reaches over the high velocity ($n_3$), the output voltage ($v_2$) of the second signal generator (13) keeps the turn-on state of the thyristor (12) before the generator of the output voltage ($v_1$) of the first generator (9). Accordingly, the thyristor (6) is turned on by the output voltage ($v_1$) generated for the specific time by the first signal generator (9) and the lead angle is not further increased over ($\theta_3$) to give the maximum lead angle ($\theta_3$) as the constant lead angle.

Figure 4:
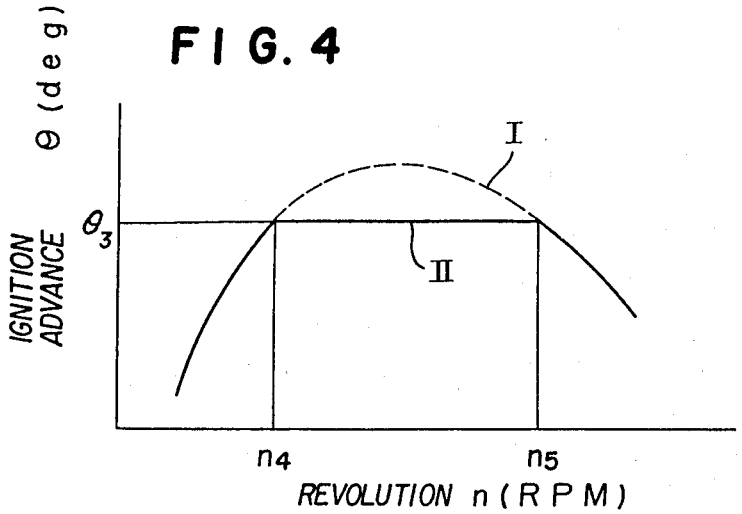
FIG. 4 is the other lead angle characteristic curve diagram.

The lead angle-lag angle characteristic curve shown in FIG. 4 can be given by said embodiment.

In the case of the ignition system using a magneto generator, the affect of the armature reaction is caused. The output voltage ($v_2$) of the second signal generator (13) in the embodiment shown in FIG. 1 is fallen as shown in FIG. 4(I) in high revolution velocity.

In accordance with said characteristic, the ignition timing ($\theta$) for the engine can be sequentially changed from the maximum lead angle to lag angles depending upon the increase of the revolution velocity (n) of the engine.

Figure 5:
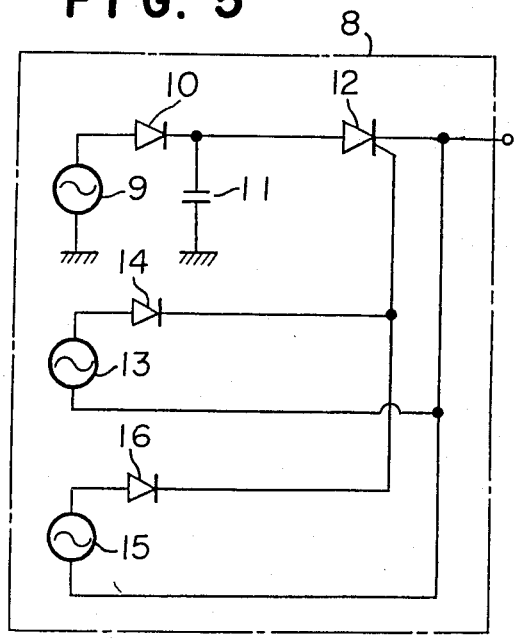
FIG. 5 is a circuit diagram of the second embodiment of the ignition system of the present invention.

FIG. 5 shows the second embodiment of the signal control circuit in the present invention.

Figure 6:
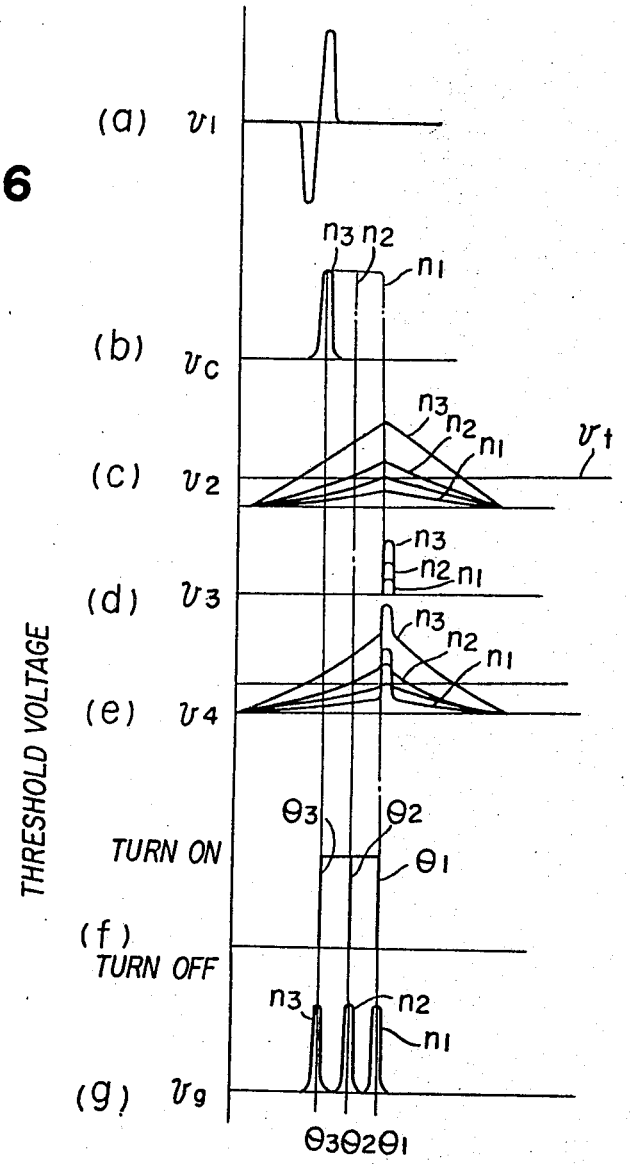
FIG. 6 is a diagram of waveforms in the ignition system.

The third signal generator (15) which generates the output voltage ($v_3$) having steep rising as shown in FIG. 6(*d*) is connected through the diode (16) between the gate and the cathode of the thyristor (12). That is, the third signal generator is connected in parallel to the second signal generator (13). FIG. 6(*e*) shows the composite output voltage ($v_4$) of the second and third signal generators (13), (15).

Figure 7:
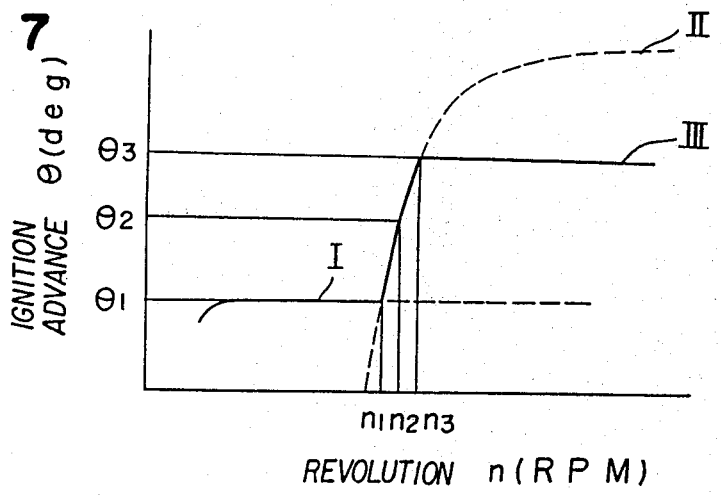
FIG. 7 is a lead angle characteristic curve diagram.

The operation will be illustrated by referring to the operation waveform diagram of FIG. 6 and the lead angle characteristic curve diagram of FIG. 7.

The output voltage ($v_2$) of the second signal generator is less than the voltage reaching to the trigger voltage ($v_t$) until the revolution velocity (n) of the engine reaches to the revolution velocity ($n_1$). On the other hand, the steep output voltage ($v_3$) of the third signal generator (15) already reaches to the trigger voltage ($v_t$) at the revolution velocity capable of the initiation of the engine. Accordingly, the composite voltage ($v_4$) which sums the steep output voltage ($v_3$) of the third signal generator (15) and the output voltage ($v_2$) of the second signal generator (13) is applied to the gate of the thyristor (12) whereby the thyristor (12) is turned on by the steep output voltage ($v_3$) of the third signal generator (15). The charge ($v_c$) of the capacitor (11) is fed through the thyristor (12) to the thyristor (6) by the turn-on of the thyristor (12). The turn-on timing changed to ($\theta_1$). This is continued until reaching the output voltage ($v_2$) to the trigger level ($v_t$). The turn-on timing of the thyristor (12) is decided by the steep output voltage ($v_3$) of the third signal generator (15) and it is maintained to be constant until the revolution velocity (n) of the engine reaches to ($n_1$). The following operation is the same as that of the embodiment shown in FIG. 1 and the description is not repeated.

In this embodiment, it is also possible to add the lag angle characteristic shown in FIG. 4. This embodiment can be applied not only CDI ignition device but also other ignition devices such as inductive ignition device.

The thyristor (12) can be substituted by the other switching means such as a transistor. Both of characteristics for zero lead angle and lead angle can be given as the lead angle characteristic.

As described above, in accordance with the present invention, firstly both of the lead angle characteristic and the maximum lead angle characteristic are electrically given and secondly, three of the zero lead angle characteristic, the lead angle characteristic and the maximum lead angle characteristic are electrically given. Accordingly, the ignition system can be formed so as to correspond to the lead angle characteristic required by the engine. Thus, the ignition system of the present invention is suitable in its practical application.

I claim:

1. In a non-contactor ignition system for generating an ignition voltage while controlling a primary current of an ignition coil by a first semiconductor switching element, the improvement comprising: a capacitor which is charged by a first power source and repeats a charging and a discharging operation in a predetermined period; a second semiconductor switching element for ignition timing which is connected to the capacitor and the input terminal of said first semiconductor switching element; a second power source which generates an output voltage and which is connected in the input circuit of said second semiconductor switching element for ignition timing and whose value is varied depending upon the variation of revolution velocity of an engine and which has a charging period including at least the charging period of said capacitor; and a third power source which is connected in parallel to said second power source and whose output voltage is steep and remarkably higher than the output voltage of said second power source.

2. A non-contactor ignition system according to claim 1 wherein said first semiconductor switching element and said second semiconductor switching element are thyristors with the anode, gate and cathode of said second semiconductor switching element being connected respectively to said first power source, said second power source and the gate of said first semiconductor switching element.

3. A non-contactor ignition system according to claim 1 wherein said capacitor is connected in parallel to said second semiconductor switching element and said first power source.

4. In a non-contactor ingition system for generating an ignition voltage while controlling a primary current of an ignition coil by a first semiconductor switching element, the improvement comprising: a capacitor which is charged by a first power source and repeats a charging and a discharging operation in a predetermined period; a second semiconductor switching element for ignition timing which is connected to the capacitor and the input terminal of said first semiconductor switching element; and a second power source which generates an output voltage and which is connected in the input circuit of said second semiconductor switching element for ignition timing and whose value is varied depending upon the variation of revolution velocity of an engine and which has a charging period including at least the charging period of said capacitor; said input circuit of said second semiconductor switching element for ignition timing, including said second power source, is an independent closed-loop circuit; said capacitor is connected in parallel to said second semiconductor switching element and said first power source; and said first semiconductor switching element and said second semiconductor switching element are thyristors with the anode, gate and cathode of said second semiconductor switching element being connected respectively to said first power source, said second power source and the gate of said first semiconductor switching element.

* * * * *